US009843167B2

(12) United States Patent
Uegaki et al.

(10) Patent No.: US 9,843,167 B2
(45) Date of Patent: Dec. 12, 2017

(54) SPARK PLUG

(71) Applicant: NGK Spark Plug Co., LTD., Nagoya (JP)

(72) Inventors: Hironori Uegaki, Nagoya (JP); Yoshitomo Iwasaki, Nagoya (JP)

(73) Assignee: NGK SPARK PLUG CO., LTD., Nagoya (JP)

( * ) Notice: Subject to any disclaimer, the term of this patent is extended or adjusted under 35 U.S.C. 154(b) by 0 days.

(21) Appl. No.: 15/291,601

(22) Filed: Oct. 12, 2016

(65) Prior Publication Data

US 2017/0110854 A1 Apr. 20, 2017

(30) Foreign Application Priority Data

Oct. 20, 2015 (JP) ..... 2015-206140

(51) Int. Cl.
*H01T 13/41* (2006.01)
*H01T 13/34* (2006.01)
*H01T 13/08* (2006.01)

(52) U.S. Cl.
CPC ..... *H01T 13/34* (2013.01); *H01T 13/08* (2013.01); *H01T 13/41* (2013.01)

(58) Field of Classification Search
CPC ..... H01T 13/34; H01T 13/08; H01T 13/36; H01T 13/20
See application file for complete search history.

(56) References Cited

U.S. PATENT DOCUMENTS 6,191,525 B1 2/2001 Tanaka et al.
6,380,664 B1 4/2002 Pollner
6,580,202 B1 * 6/2003 Pollner ..... H01T 13/41 313/143
7,443,089 B2 * 10/2008 Hoffman ..... H01T 13/41 313/141
9,614,354 B2 * 4/2017 Yoshida ..... H01T 13/41
2007/0290594 A1 12/2007 Hoffman et al.
2016/0006220 A1 * 1/2016 Kersting ..... H01T 13/34 313/135
2017/0033538 A1 * 2/2017 Kobayashi ..... H01T 13/36

FOREIGN PATENT DOCUMENTS

JP 2002-509638 A 3/2002
JP 2009-541916 A 11/2009

OTHER PUBLICATIONS

Extended European Search Report dated Mar. 8, 2017 for the corresponding European Patent Application No. 16192686.0.

* cited by examiner

*Primary Examiner* — Joseph L Williams
*Assistant Examiner* — Jose M Diaz
(74) *Attorney, Agent, or Firm* — Leason Ellis LLP

(57) ABSTRACT

An electrically-conductive seal portion of a spark plug includes a large-diameter seal portion, a small-diameter seal portion having an outer diameter smaller than an outer diameter of the large-diameter seal portion, and a tapered seal portion disposed between the large-diameter seal portion and the small-diameter seal portion. An insulator includes a flange portion, a first middle-body portion having an outer diameter smaller than an outer diameter of the flange portion, a second middle-body portion having an outer diameter smaller than an outer diameter of the first middle-body portion, and a leg portion having an outer diameter that tapers toward a tip end of the spark plug. The tapered seal portion is disposed inside the first middle-body portion.

11 Claims, 6 Drawing Sheets

FIG. 5

| SAMPLE | NOMINAL DIAMETER OF SCREW PORTION 9 | OUTER DIAMETER [mm] OF SMALL-DIAMETER SEAL PORTION 67 | THICKNESS [mm] OF SECOND MIDDLE-BODY PORTION 34 | INSULATOR BROKEN OR NOT IN HOT PRESS |
|---|---|---|---|---|
| S01 | M12 | 3.9 | 1.7 | NONE |
| S02 | M12 | 3.0 | 2.2 | NONE |
| S03 | M10 | 3.9 | 1.2 | SOME |
| S04 | M10 | 3.5 | 1.4 | NONE |
| S05 | M10 | 3.0 | 1.6 | NONE |
| S06 | M10 | 2.7 | 1.8 | NONE |

FIG. 6

| SAMPLE | OUTER DIAMETER [mm] OF ELECTRICALLY-CONDUCTIVE SEAL PORTION | | OUTER DIAMETER RATIO | COMPRESSED STATE OF MATERIAL OF ELECTRICALLY-CONDUCTIVE SEAL PORTION 60 |
|---|---|---|---|---|
| | LARGE-DIAMETER SEAL PORTION 65 | SMALL-DIAMETER SEAL PORTION 67 | | |
| S11 | 3.90 | 3.50 | 0.90 | SUFFICIENT |
| S12 | 3.50 | 3.40 | 0.97 | SOME |
| S13 | 3.50 | 3.00 | 0.86 | SUFFICIENT |
| S14 | 3.50 | 2.70 | 0.77 | SUFFICIENT |
| S15 | 3.50 | 2.64 | 0.75 | SUFFICIENT |
| S16 | 3.50 | 2.50 | 0.71 | SOME |
| S17 | 3.00 | 2.70 | 0.90 | SUFFICIENT |
| S18 | 3.00 | 2.50 | 0.83 | SUFFICIENT |

SPARK PLUG

CROSS REFERENCE TO THE RELATED APPLICATIONS

This application claims the benefit of Japanese Patent Application No. 2015-206140, filed Oct. 20, 2015, which is incorporated herein in its entirety by reference.

BACKGROUND OF THE INVENTION

1. Field of the Invention

The present invention relates to spark plugs.

2. Description of the Related Art

A typical spark plug for use in an internal-combustion engine includes a tubular metal shell, a tubular insulator disposed in an inner hole of the metal shell, a central electrode disposed in a tip-end-side axial hole of the insulator, a metal terminal disposed in a rear axial hole, and a ground electrode having two ends, one of which is joined to a tip-end side of the metal shell and the other one of which is disposed so as to face the central electrode to form a spark discharge gap therebetween. In the axial hole of the insulator and between the central electrode and the metal terminal, a glass seal portion (also referred to as an "electrically-conductive seal portion") containing a resistive material for noise reduction is disposed.

A typical glass seal portion is formed by compressing, by hot press, a glass-seal-use powder material containing resistive powder and glass powder. For performing hot press, the central electrode, the glass-seal-use powder material, and the metal terminal are sequentially inserted into the axial hole of the insulator and compressed by hot press, so that the glass-seal-use powder material is consolidated. This consolidation enhances the properties (load life characteristics) of the resistive material of the glass seal portion. In addition, the glass seal portion is fixedly attached to the central electrode and the metal terminal and exerts its effect of impact resistance (shock absorption) or airtightness.

With the development of internal-combustion engines in recent years, reduction of the diameter of a spark plug has been demanded. The reduction of the diameter of a spark plug involves reduction of the outer diameter of the insulator. This reduction of the outer diameter causes a problem of rendering the insulator easily breakable and various other problems described below.

First, a case is assumed where the inner diameter of the axial hole of the insulator is retained at the same level as the inner diameter of an axial hole of an existing insulator despite the reduction of the outer diameter of the insulator. In this case, the insulator is thinned in accordance with the amount of reduction of the outer diameter of the insulator. Thus, the voltage resistance characteristics are more likely to decrease and the insulator is rendered more easily breakable as a result of failing to endure the inner pressure that occurs during a hot press operation. This configuration, however, is advantageous in that it allows the use of metal terminals having an outer diameter the same as that of existing metal terminals since the inner diameter of the axial hole of the insulator remains unchanged from that of an existing insulator and that the load the same as that of the case of an existing spark plug can be transmitted to the glass-seal-use powder material during a hot press operation.

Second, a case is assumed where the diameter of the axial hole of the insulator is reduced in order to secure the thickness of the insulator after the reduction of the outer diameter of the insulator. In this case, a metal terminal inserted in the axial hole of the insulator is also accordingly thinned. When the metal terminal is thinned, the metal terminal may be bent as a result of being yielded by the load that occurs during a hot press operation. When the metal terminal is bent, the load that occurs during a hot press operation fails to be fully transmitted to the glass-seal-use powder material, whereby properties (for example, shock resistance or resistive material properties) may become insufficient. This configuration, however, allows the insulator to have a thickness the same as the thickness of an existing insulator. Thus, the insulator is advantageous in that it has the same voltage resistance characteristics and it is less easily breakable during a hot press operation.

To address the above-described problems in the first and second cases, a technology is known in which a tapered portion is disposed in the glass seal portion (Japanese Unexamined Patent Application Publication No. 2009-541916). In Japanese Unexamined Patent Application Publication No. 2009-541916, a tapered portion is provided inside a large-diameter portion (flange portion) of the insulator. In the tapered portion, the outer diameter of the glass seal portion (that is, the axial hole diameter of the insulator) decreases toward the tip end of the spark plug. This configuration enables an increase of the axial hole diameter of the insulator at a portion into which the metal terminal is inserted while the thickness of the insulator at a middle body portion disposed closer to the tip end than the large-diameter portion of the insulator is secured. Thus, the metal terminal can retain a large outer diameter. As a result, the metal terminal is rendered less easily bendable also during a hot press operation, so that insufficient compression of the glass-seal-use powder material due to bending of the metal terminal is less likely to occur.

Patent Literature

However, the plug shape (or product number) of spark plugs ranges widely so that the spark plugs are optimized for engines in which they are installed. If, as in the case of Japanese Unexamined Patent Application Publication No. 2009-541916, the position of the tapered portion of the glass seal portion is fixed to the inner side of the large-diameter portion of the insulator for avoiding breakage of the insulator, various other problems occur. Specifically, if the position of the tapered portion of the glass seal portion is to be fixed to the inner side of the large-diameter portion of the insulator, the amount of the glass-seal-use powder material has to vary, to a large extent, with product number since the length of the glass seal portion varies with plug shape. Moreover, if the length of the resistive-material portion inside the glass seal portion varies with product number, enormous types of resistive-material-use powder material have to be prepared due to the need for use of resistive-material-use powder materials having different specific resistances in order that different types of resistive-material-use powder material have the same resistance.

In these days, longreach (elongated) spark plugs have been increasingly desired. Thus, in the case where a tapered portion of the glass seal portion is disposed on the inner side of the large-diameter portion of the insulator, the entirety of the glass seal portion has to be elongated further. When a long glass seal portion is used, it involves a long stroke during a hot press operation, and a long stroke makes it difficult to vertically insert the metal terminal into the glass seal portion, thereby causing a problem of low productivity.

From the above-described various reasons, a technology is desired that can render an insulator less easily breakable when an axial hole of the insulator is filled with a material of a glass seal portion (electrically-conductive seal portion) without fixing the position of a tapered portion of the glass seal portion to the inner side of a large-diameter portion (flange portion) of the insulator.

SUMMARY OF THE INVENTION

The present invention was made to solve the above-described problems and can be embodied in the following forms.

(1) A first aspect of the present invention provides a spark plug that includes an insulator having an axial hole extending in a direction of an axial line, a central electrode held in the axial hole at a portion closer to a first end of the axial hole, a metal terminal held in the axial hole at a portion closer to a second end of the axial hole, an electrically-conductive seal portion that occupies the axial hole of the insulator to electrically connect the central electrode and the metal terminal to each other, and a metal shell that houses the insulator. The electrically-conductive seal portion includes a large-diameter seal portion, a small-diameter seal portion disposed closer to a tip end of the spark plug than the large-diameter seal portion and having an outer diameter smaller than an outer diameter of the large-diameter seal portion, and a tapered seal portion disposed between the large-diameter seal portion and the small-diameter seal portion. The insulator includes a flange portion, a first middle-body portion disposed closer to the tip end than the flange portion and having an outer diameter smaller than an outer diameter of the flange portion, a second middle-body portion disposed closer to the tip end than the first middle-body portion and having an outer diameter smaller than an outer diameter of the first middle-body portion, and a leg portion disposed closer to the tip end than the second middle-body portion and having an outer diameter that tapers toward the tip end. The tapered seal portion is disposed inside the first middle-body portion.

If the portion of the insulator that houses the tapered seal portion has a small thickness, the portion of the insulator that houses the large-diameter seal portion disposed closer to the rear end than the tapered seal portion is rendered excessively small, whereby the insulator may be broken when the axial hole of the insulator is filled with the material of the electrically-conductive seal portion. According to the spark plug having the above-described structure, the first middle-body portion that houses the tapered seal portion has an outer diameter larger than the outer diameter of the second middle-body portion. Thus, the insulator is rendered less easily breakable when the axial hole of the insulator is filled with the material of the electrically-conductive seal portion.

(2) In the above-described spark plug, a screw portion disposed on an outer circumferential surface of the metal shell may have a nominal diameter smaller than or equal to M10. The small-diameter seal portion may have an outer diameter smaller than or equal to 3.5 mm. An outer diameter of a tip end portion of the metal terminal may be larger than the outer diameter of the small-diameter seal portion.

If the small-diameter seal portion has an outer diameter smaller than or equal to 3.5 mm, the portion of the insulator disposed on the outer side of the small-diameter seal portion can have a large thickness. Thus, the insulator is rendered less easily breakable when the axial hole of the insulator is filled with the material of the electrically-conductive seal portion. In addition, since the outer diameter of the tip end portion of the metal terminal is larger than the outer diameter of the small-diameter seal portion, the metal terminal is less likely to be bent when the axial hole of the insulator is filled with the material of the electrically-conductive seal portion.

(3) In the above-described spark plug, a tip end of the metal terminal may be disposed inside the tapered seal portion.

In this spark plug, when the axial hole of the insulator is filled with the material of the electrically-conductive seal portion, the small-diameter seal portion disposed closer to the tip end than the tapered seal portion is compressed at sufficiently high material compressibility. Thus, the electrically-conductive seal portion can have sufficiently high electric conductivity.

(4) In the above-described spark plug, the electrically-conductive seal portion may include a resistive-material phase made of a resistive material, a rear-end seal phase disposed closer to a rear end of the spark plug than the resistive-material phase and made of a glass seal material, and a tip-end seal phase disposed closer to the tip end of the spark plug than the resistive-material phase and made of the glass seal material. The tapered seal portion may include the rear-end seal phase.

The portion closer to the tip end than the tapered seal portion can be fully compressed even with a small load of the metal terminal since the load per unit area is increased by a reduction of the sectional area. The rear-end side of the tapered seal portion on the other hand fails to benefit from the reduction of the sectional area. To address this circumstance, the resistive-material phase, having a high noise reduction effect, is disposed closer to the tip end than the tapered seal portion and the rear-end seal phase disposed on the rear end of the resistive-material phase is tapered. Thus, the rear-end seal phase is directly compressed by the metal terminal and the tip-end seal phase and the resistive-material phase are fully compressed. The rear-end seal phase has higher pressure transmissibility than the resistive-material phase so that it can be fully compressed even without being tapered and thus can have high electric conductivity.

(5) In the above-described spark plug, a ratio of the outer diameter of the small-diameter seal portion to the outer diameter of the large-diameter seal portion may be larger than or equal to 0.75 and smaller than or equal to 0.90.

The material compressibility of the seal portion at the time when the axial hole of the insulator is filled with the material of the electrically-conductive seal portion and the electric conductivity of the electrically-conductive seal portion increase with increasing difference between outer diameters (difference between sectional areas) of the large-diameter seal portion and the small-diameter seal portion. Thus, the ratio of the outer diameter of the small-diameter seal portion to the outer diameter of the large-diameter seal portion is preferably smaller than or equal to 0.90. When the outer diameter ratio is smaller than 0.75, the degree of tapering of the tapered seal portion becomes large, so that the resistance against pressing force exerted while the insulator is filled with the material of the electrically-conductive seal portion increases excessively. Thus, the outer diameter ratio is preferably larger than or equal to 0.75.

The present invention can be embodied in various modes. For example, the present invention can be embodied in the form of, for example, a spark plug or a method for manufacturing a spark plug.

BRIEF DESCRIPTION OF THE DRAWINGS

These and other features and advantages of the present invention will become more readily appreciated when considered in connection with the following detailed description and appended drawings, wherein like designations denote like elements in the various views, and wherein:

FIG. 5 shows results of a breakage test of insulators during a hot press operation; and FIG. 6 shows results of a compression test of electrically-conductive seal portions.

DETAILED DESCRIPTION OF THE INVENTION

Figure 1:
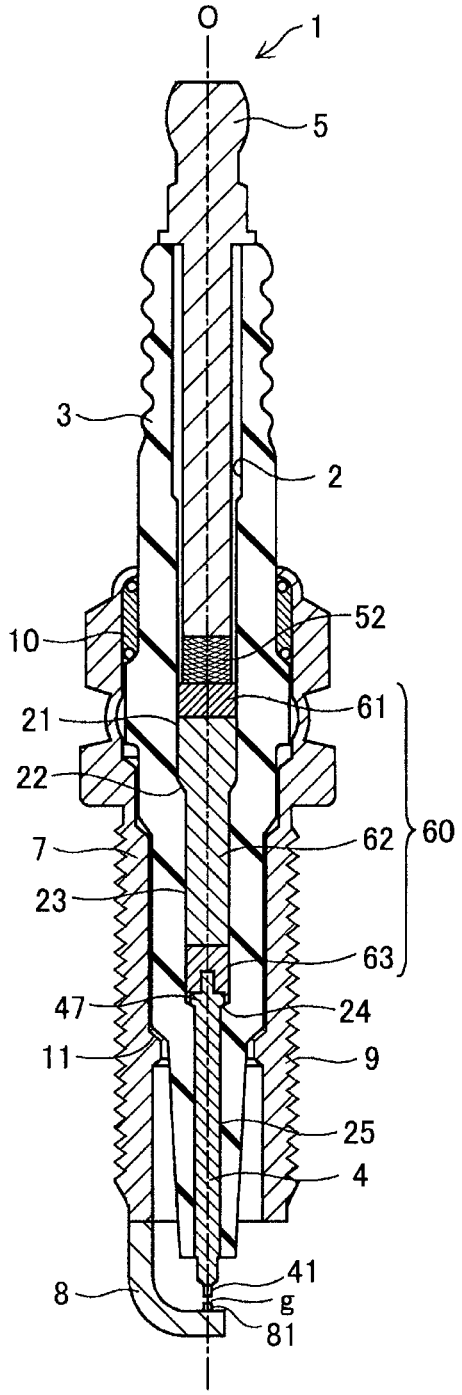
FIG. 1 illustrates a structure of a spark plug according to an embodiment.

FIG. 1 illustrates an entire configuration of a spark plug 1 according to an embodiment of the present invention. The lower side in FIG. 1 (ignition side) is expressed as closer to the tip end of the spark plug 1 and the upper side in FIG. 1 is expressed as closer to the rear end of the spark plug 1. The spark plug 1 includes an insulator 3, which has an axial hole 2 that extends in a direction of an axial line O, a central electrode 4, held in the axial hole 2 at a portion closer to a tip end of the axial hole 2, a metal terminal 5, held in the axial hole 2 at a portion closer to a rear end of the axial hole 2, an electrically-conductive seal portion 60, which electrically connects the central electrode 4 and the metal terminal 5 together inside the axial hole 2, a metal shell 7, which houses the insulator 3, and a ground electrode 8 having two ends, one of which is joined to a tip-end surface of the metal shell 7 and the other of which is disposed so as to face the central electrode 4 with a gap interposed therebetween.

The metal shell 7 has a substantially cylindrical shape so as to house and hold the insulator 3. A screw portion 9 is formed on the outer circumferential surface of the metal shell 7 at a portion closer to the tip end. By using this screw portion 9, the spark plug 1 is mounted on a cylinder head of an internal-combustion engine, not illustrated. The screw portion 9 has dimensions and a shape that correspond to a so-called nominal diameter. Examples of the nominal diameter of the screw portion 9 of a typical spark plug include M8, M10, M12, M14, and M18.

The insulator 3 is held on an inner circumferential portion of the metal shell 7 with a talc 10 and a packing 11 interposed therebetween. The insulator 3 is fixed to the metal shell 7 in the state where a tip end portion of the insulator 3 protrudes from the tip end surface of the metal shell 7. The axial hole 2 of the insulator 3 is divided into several sections having different inner diameters. Specifically, a first middle-diameter diameter axial hole portion 21, into which the tip end of the metal terminal 5 is inserted, is disposed around the middle portion of the axial hole 2. On a portion closer to the tip end than the first middle-diameter axial hole portion 21, a first axial-hole stepped portion 22, a second middle-diameter axial hole portion 23, a second axial-hole stepped portion 24, and a small-diameter axial hole portion 25 are disposed in this order. Each of the first axial-hole stepped portion 22 and the second axial-hole stepped portion 24 is a portion of the axial hole 2 having an inner diameter that tapers toward the tip end. Thus, the inner diameter has the following relationship: first middle-diameter axial hole portion 21>second middle-diameter axial hole portion 23>small-diameter axial hole portion 25. The small-diameter axial hole portion 25 houses the central electrode 4. In this embodiment, the electrically-conductive seal portion 60 is housed in the axial hole 2 of the insulator 3 over a range extending from the tip of the second middle-diameter axial hole portion 23 (that is, the position of the second axial-hole stepped portion 24) to some midpoint of the first middle-diameter axial hole portion 21. The configuration of the electrically-conductive seal portion 60 is described below. The insulator 3 is preferably made of a material having sufficiently high mechanical strength, heat resistance, and electric shock resistance. Examples usable as such a material include a sintered ceramic body mainly composed of alumina.

The central electrode 4 is insulated from and held by the metal shell 7 in the state where a flange portion 47 of the central electrode 4, disposed at the rear end and having a large diameter, is locked on the second axial-hole stepped portion 24 of the insulator 3 and the tip end portion of the central electrode 4 protrudes from the tip end surface of the insulator 3. Preferably, the central electrode 4 is made of a material having sufficiently high thermal conductivity and mechanical strength. For example, the central electrode 4 is made of a Ni-based alloy such as Inconel (trademark). The axial portion of the central electrode 4 may be made of a metal material having high thermal conductivity such as Cu or Ag.

One end of the ground electrode 8 is joined to the tip end surface of the metal shell 7. The ground electrode 8 is bent at some midpoint so as to have a substantially L shape and so that a tip end portion of the ground electrode 8 faces the tip end portion of the central electrode 4 with a gap interposed therebetween. The ground electrode 8 is made of a material the same as the material of the central electrode 4.

On the surfaces that the central electrode 4 and the ground electrode 8 face each other, precious metal tips 41 and 81 made of a material such as a platinum alloy and an iridium alloy are disposed. A spark discharge gap g is defined between the precious metal tips 41 and 81. One of or both of the precious metal tips of the central electrode 4 and the ground electrode 8 may be omitted.

The metal terminal 5 is a terminal for applying, from the outside to the central electrode 4, a voltage for performing spark discharge between the central electrode 4 and the ground electrode 8. A tip end portion 52 of the metal terminal 5 has an uneven surface. In the mode illustrated in FIG. 1, the outer circumferential surface of the tip end portion 52 is knurled. When the surface of the tip end portion 52 is rendered uneven by being knurled, the degree of attachment between the metal terminal 5 and the electrically-conductive seal portion 60 is enhanced, whereby the metal terminal 5 and the insulator 3 are firmly fixed together. The metal terminal 5 is made of, for example, low-carbon steel and a Ni metal layer is formed by, for example, plating on the surface of the metal terminal 5.

The electrically-conductive seal portion 60 is disposed in the axial hole 2 of the insulator 3 between the central electrode 4 and the metal terminal 5 to electrically connect the central electrode 4 and the metal terminal 5 together. The electrically-conductive seal portion 60 includes a rear-end seal phase 61, a resistive-material phase 62 disposed closer to the tip end than the rear-end seal phase 61, and a tip-end seal phase 63 disposed closer to the tip end than the resistive-material phase 62. The rear-end seal phase 61 and the tip-end seal phase 63 are formed by thermally melting a seal-use powder mixture composed of, for example, metal powder and glass powder. The resistive-material phase 62 is formed by thermally melting a resistive-material-use powder mixture composed of, for example, carbon powder, metal powder, glass powder, and oxide powder. More specifically, the electrically-conductive seal portion 60 is formed by hot press in the following manner. First, the central electrode 4 is inserted into the axial hole 2 of the insulator 3. Then, the powder materials of the tip-end seal phase 63, the resistive-material phase 62, and the rear-end seal phase 61 are sequentially poured into the axial hole 2 and pressed. The metal terminal 5 is then inserted into the axial hole 2. While the metal terminal 5 is pressed from the rear end, the entirety is heated together with the insulator 3 to melt the powder material and then cooled. Consequently, the consolidated electrically-conductive seal portion 60 is formed in the state where the tip end portion 52 of the metal terminal 5 is fixedly attached to the rear-end seal phase 61 and the flange portion 47 of the central electrode 4 is fixedly attached to the tip-end seal phase 63. This consolidation enhances the performance (load life characteristics or the like) of the resistive-material phase 62. In addition, the electrically-conductive seal portion 60, fixedly attached to the central electrode 4 and the metal terminal 5, exerts the effects of shock resistance (shock absorbency) and airtightness.

Figure 2:
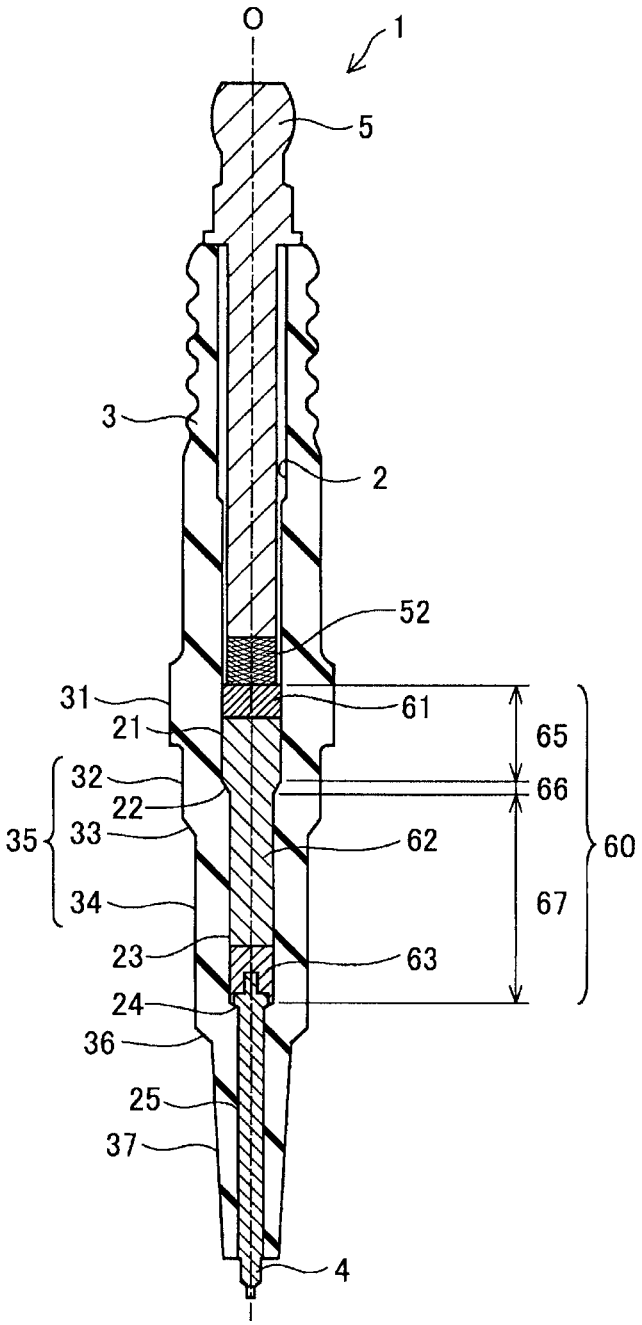
FIG. 2 illustrates the spark plug from which a metal shell is removed.

FIG. 2 illustrates the state where the metal shell 7 is removed from the spark plug 1 illustrated in FIG. 1. The insulator 3 has the following portions characterized by their outer shapes and having different outer diameters:

a flange portion 31, disposed around the middle portion of the insulator 3 and having the largest outer diameter;

a first middle-body portion 32, disposed closer to the tip end than the flange portion 31 and having an outer diameter smaller than the outer diameter of the flange portion 31;

a first tapered portion 33, disposed closer to the tip end than the first middle-body portion 32 and having an outer diameter that tapers toward the tip end;

a second middle-body portion 34, disposed closer to the tip end than the first tapered portion 33 and having an outer diameter smaller than the outer diameter of the first middle-body portion 32;

a middle body portion 35, which is a combination of the first middle-body portion 32, the first tapered portion 33, and the second middle-body portion 34;

a second tapered portion 36, disposed closer to the tip end than the second middle-body portion 34 and having an outer diameter that tapers toward the tip end; and leg portion 37, disposed closer to the tip end than the second tapered portion 36 and having an outer diameter that tapers toward the tip end.

In the description, the "outer diameter" represents a "diameter". The "outer diameter" of a member whose cross section is not a perfect circle represents a diameter of a hypothetically circular cross section of the member.

The range in the axial hole 2 of the insulator 3 over which the electrically-conductive seal portion 60 is housed extends over the first middle-diameter axial hole portion 21, the first axial-hole stepped portion 22, and the second middle-diameter axial hole portion 23. The electrically-conductive seal portion 60 can be divided as follows so as to correspond to the divisions of the axial hole 2 of the insulator 3:

a large-diameter seal portion 65, which is a seal portion disposed in the first middle-diameter axial hole portion 21;

a tapered seal portion 66, which is a seal portion disposed in the first axial-hole stepped portion 22; and a small-diameter seal portion 67, which is a seal portion disposed in the second middle-diameter axial hole portion 23.

In the example illustrated in FIG. 2, the large-diameter seal portion 65 includes a portion of the resistive-material phase 62 and the rear-end seal phase 61. The small-diameter seal portion 67 includes a portion of the resistive-material phase 62 and the tip-end seal phase 63. However, this correspondence is changeable.

In the embodiment, the tapered seal portion 66 is disposed in the first middle-body portion 32, which has the largest outer diameter in the middle body portion 35 of the insulator 3. The first middle-body portion 32 has a larger outer diameter than the second middle-body portion 34, disposed closer to the tip end than the first middle-body portion 32. When the tapered seal portion 66 is disposed in the first middle-body portion 32 in this manner, the portion of the insulator that houses the large-diameter seal portion 65 disposed closer to the rear end than the tapered seal portion 66 can have a larger minimum thickness than in the case where the tapered seal portion 66 is disposed in the second middle-body portion 34. If the portion of the insulator that houses the tapered seal portion 66 has a small thickness (in the case where, for example, the tapered seal portion 66 is disposed in the second middle-body portion 34), the portion of the insulator that houses the large-diameter seal portion 65 disposed closer to the rear end than the tapered seal portion 66 may have an excessively small minimum thickness. Thus, in this case, the insulator 3 may be broken while being filled with the material of the electrically-conductive seal portion 60. In the embodiment, in contrast, the portion of the insulator that houses the large-diameter seal portion 65 can have a large thickness since the outer diameter of the first middle-body portion 32 that houses the tapered seal portion 66 is larger than the outer diameter of the second middle-body portion 34. This configuration can thus render the insulator 3 less easily breakable while being filled with the material of the electrically-conductive seal portion 60 (during a hot press operation). To impose a sufficiently large load on the electrically-conductive seal portion 60 during a hot press operation, preferably, the outer diameter of the tip end portion 52 of the metal terminal 5 is set larger than the outer diameter of the small-diameter seal portion 67.

Figures 3A, 3B, 3C, 3D, 3E:
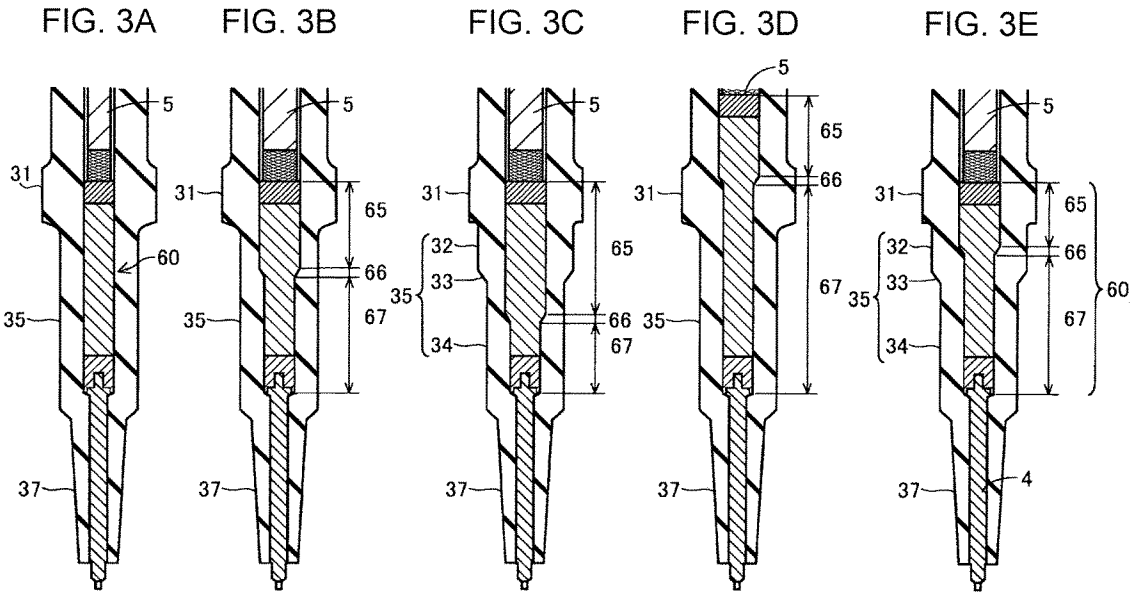
FIGS. 3A to 3E illustrate structures of the embodiment and comparative examples for comparison.

FIGS. 3A to 3E illustrate structures of the embodiment and comparative examples for comparison. FIG. 3E illustrates a structure of the embodiment, which is the same as the structure illustrated in FIG. 2. FIGS. 3A to 3D illustrate different structures of different comparative examples. The characteristics of the structures of the comparative examples are described below.

(1) First Comparative Example Illustrated in FIG. 3A

The structure of the first comparative example is different from the structure illustrated in FIG. 3E in that the electrically-conductive seal portion 60 does not include the tapered seal portion 66 and the electrically-conductive seal portion 60 has a uniform outer diameter throughout its length. In the structure of the first comparative example, the outer diameter of the rear end portion of the electrically-conductive seal portion 60 and the outer diameter of the metal terminal 5 are smaller than those in the structure illustrated in FIG. 3E. Thus, it is difficult to transmit a sufficiently large load to the electrically-conductive seal portion 60 when the insulator 3 is filled with the material of the electrically-conductive seal portion 60 (during a hot press operation).

(2) Second Comparative Example Illustrated in FIG. 3B

The structure of the second comparative example is the same as the structure illustrated in FIG. 3E in that the tapered seal portion 66 is disposed inside the middle body portion 35 but is different from the structure illustrated in FIG. 3E in that the middle body portion 35 does not have a stepped portion at which the outer diameter is changed. In the structure of the second comparative example, the insulator 3 may be broken while being filled with the material of the electrically-conductive seal portion 60 since the portion of the insulator that houses the large-diameter seal portion 65 has a small minimum thickness.

(3) Third Comparative Example Illustrated in FIG. 3C

The structure of the third comparative example is the same as the structure illustrated in FIG. 3E in that the middle body portion 35 includes the first tapered portion 33 and the electrically-conductive seal portion 60 includes the tapered seal portion 66. The structure of the third comparative example is however different from the structure illustrated in FIG. 3E in that the tapered seal portion 66 of the electrically-conductive seal portion 60 is disposed not inside the first middle-body portion 32 but inside the second middle-body portion 34 having a smaller outer diameter than the first middle-body portion 32. Also in the structure of this third comparative example, the insulator 3 may be broken while being filled with the material of the electrically-conductive seal portion 60 since the portion of the insulator that houses the large-diameter seal portion 65 has a small minimum thickness.

(4) Fourth Comparative Example Illustrated in FIG. 3D

The structure of the fourth comparative example is the same as the structure illustrated in FIG. 3E in that the electrically-conductive seal portion 60 includes the tapered seal portion 66. However, the structure of the fourth comparative example is different from the structure illustrated in FIG. 3E in that the middle body portion 35 does not include a step portion at which the outer diameter is changed and that the tapered seal portion 66 is disposed inside the flange portion 31. In the structure of the fourth comparative example, the insulator 3 is not broken while being filled with the material of the electrically-conductive seal portion 60 since the portion of the insulator that houses the large-diameter seal portion 65 has a sufficiently large thickness. However, as described in Description of the Related Art, a stroke during a hot press operation is elongated due to elongation of the electrically-conductive seal portion 60, which makes it difficult to vertically insert the metal terminal 5, thereby causing a problem of low productivity.

As described above, in the embodiment, the first middle-body portion 32 that houses the tapered seal portion 66 has a larger outer diameter than the outer diameter of the second middle-body portion 34. Thus, the insulator is rendered less easily breakable while being filled with the material of the electrically-conductive seal portion 60. In addition, the embodiment has the above-described various advantages over the comparative examples illustrated in FIGS. 3A to 3D, which do not have such characteristics.

Figure 4:
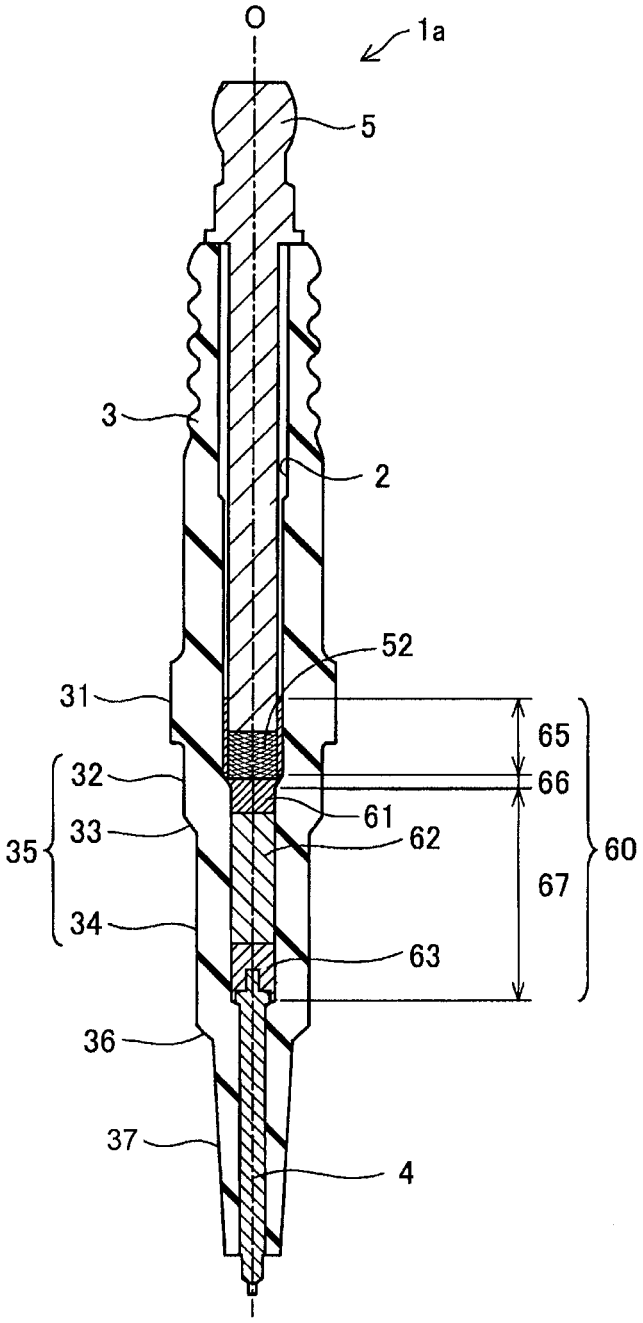
FIG. 4 illustrates a structure of a spark plug according to a modification example.

FIG. 4 illustrates a structure of a spark plug 1*a* according to a modification example and corresponds to the structure of the above-described embodiment illustrated in FIG. 2. The spark plug 1*a* according to the modification example is different from the above-described embodiment in that the tip end of the metal terminal 5 (the tip end surface of the tip end portion 52) is disposed inside the tapered seal portion 66 and the tapered seal portion 66 is constituted of the rear-end seal phase 61. Other part of the structure of the spark plug 1*a* is the same as the structure according to the embodiment. In the structure according to the modification example, the small-diameter seal portion 67 disposed closer to the tip end than the tapered seal portion 66 is compressed at a sufficiently large material compressibility ratio when the axial hole 2 of the insulator 3 is filled with the material of the electrically-conductive seal portion 60, whereby the electrically-conductive seal portion 60 can have sufficiently high electric conductivity.

The reason why the tapered seal portion 66 is constituted of the rear-end seal phase 61 in this spark plug 1*a* is described below. The portion closer to the tip end than the tapered seal portion 66 can be fully compressed even with a small load of the metal terminal 5 since the load per unit area is increased by a reduction of the sectional area. The rear-end side of the tapered seal portion 66 on the other hand fails to benefit from the reduction of the sectional area. To address this circumstance, the resistive-material phase 62, having a high noise reduction effect, is disposed closer to the tip end than the tapered seal portion 66 and the rear-end seal phase 61 disposed closer to the rear end than the resistive-material phase 62 is tapered, so that the rear-end seal phase 61 is directly compressed by the metal terminal 5 and the tip-end seal phase 63 and the resistive-material phase 62 are fully compressed. The rear-end seal phase 61 has higher pressure transmissibility than the resistive-material phase 62 so that it can be fully compressed even without the reduction of the diameter and thus can have high electric conductivity.

FIG. 5 shows results of a breakage test of the insulator 3 of the spark plug 1 having the structure illustrated in FIG. 1 and FIG. 2 during a hot press operation. FIG. 5 shows the results of the test conducted on 30 test pieces each of six different types of samples S01 to S06 using, as parameters, the nominal diameter of the screw portion 9, the outer diameter of the small-diameter seal portion 67, and the thickness of the second middle-body portion 34. In the right end column of FIG. 5, "NONE" represents that none of the insulators 3 were broken and "SOME" represents that some of the insulator 3 were broken. As is understood from these results, the samples S01 to S02 and S04 to S06 other than the sample S03 are preferable because none of the insulators 3 were broken during a hot press operation. The reason for this is probably because, in each of these samples S01 to S02 and S04 to S06, the second middle-body portion 34 disposed on the outer side of the small-diameter seal portion 67 has a sufficiently large thickness. In consideration of this point, preferably, the second middle-body portion 34 has a thickness larger than or equal to 1.4 mm. In view of a property of breakage resistance, the second middle-body portion 34 having a larger thickness is more preferable but the thickness may be, for example, smaller than or equal to 2.4 mm or smaller than or equal to 2.2 mm.

As illustrated in FIG. 1 and FIG. 2, the above-described samples S01 to S06 have a point in common, that is, the outer diameter of the tip end portion 52 of the metal terminal 5 is larger than the outer diameter of the small-diameter seal portion 67. In consideration of a demand for a reduction of the spark plug diameter, preferably, the nominal diameter of the screw portion 9 of the metal shell 7 is smaller than or equal to M10 and the outer diameter of the small-diameter seal portion 67 is smaller than or equal to 3.5 mm. More preferably, the nominal diameter of the screw portion 9 is M10 and the outer diameter of the small-diameter seal portion 67 is larger than or equal to 2.7 mm and smaller than or equal to 3.5 mm.

FIG. 6 shows results of a compression test of the electrically-conductive seal portion 60 of the spark plug 1 having the structure illustrated in FIG. 1 and FIG. 2. FIG. 6 shows the results of the test conducted on 30 test pieces each of eight different types of samples S11 to S18 using, as parameters, the outer diameter of the large-diameter seal portion 65 and the outer diameter of the small-diameter seal portion 67. Here, "OUTER DIAMETER RATIO" represents the ratio of the outer diameter of the small-diameter seal portion to the outer diameter of the large-diameter seal portion 65. In the right end column of FIG. 6, "SUFFICIENT" represents that the material compressibility of the electrically-conductive seal portions 60 of all the test pieces after hot press arrived at or exceeded a reference value and "SOME INSUFFICIENT" represents that the material compressibility of the electrically-conductive seal portions 60 of some of the test pieces failed to arrive at the reference value. According to the test results, the samples S11, S13 to S15, S17, and S18 having the outer diameter ratio from 0.75 to 0.90 are preferable since the material compressibility of the electrically-conductive seal portion 60 is increased to a sufficiently high level during a hot press operation. In general, the material compressibility of the electrically-conductive seal portion 60 during a hot press operation and the electric conductivity of the electrically-conductive seal portion 60 increase with increasing difference between outer diameters (difference between sectional areas) of the large-diameter seal portion 65 and the small-diameter seal portion 67. Thus, the ratio of the outer diameter of the small-diameter seal portion 67 to the outer diameter of the large-diameter seal portion 65 is preferably smaller than or equal to 0.90. When the outer diameter ratio is smaller than 0.75, the degree of tapering of the tapered seal portion 66 becomes large, so that the resistance against pressing force exerted while the insulator 3 is filled with the material of the electrically-conductive seal portion 60 increases excessively. Thus, the outer diameter ratio is preferably larger than or equal to 0.75.

Other Modification Examples

The invention is not limited to the above-described examples or embodiment and can be embodied in various modes within the scope not departing from the gist of the invention.

Modification Example 1

The present invention is applicable to spark plugs having various structures other than the structure illustrated in FIG. 1 and FIG. 2.

What is claimed is:

1. A spark plug, comprising:

an insulator having an axial hole extending in a direction of an axial line;

a central electrode held in the axial hole at a portion closer to a first end of the axial hole;

a metal terminal held in the axial hole at a portion closer to a second end of the axial hole;

an electrically-conductive seal portion that occupies the axial hole of the insulator to electrically connect the central electrode and the metal terminal to each other;

a metal shell that houses the insulator; and a packing that is interposed between the insulator and the metal shell and abuts an outer surface of the insulator, wherein the electrically-conductive seal portion includes a large-diameter seal portion, a small-diameter seal portion disposed closer to a tip end of the spark plug than the large-diameter seal portion and having an outer diameter smaller than an outer diameter of the large-diameter seal portion, and a tapered seal portion disposed between the large-diameter seal portion and the small-diameter seal portion, the insulator includes a flange portion, a first middle-body portion disposed closer to the tip end than the flange portion and having an outer diameter smaller than an outer diameter of the flange portion, a second middle-body portion disposed closer to the tip end than the first middle-body portion and having an outer diameter smaller than an outer diameter of the first middle-body portion, and a leg portion disposed closer to the tip end than the second middle-body portion and having an outer diameter that tapers toward the tip end, the leg portion extends in the direction of the axial line from a portion of the insulator that abuts the packing, and the tapered seal portion is disposed inside the first middle-body portion.

2. The spark plug according to claim 1, wherein a screw portion disposed on an outer circumferential surface of the metal shell has a nominal diameter smaller than or equal to M10, and wherein the small-diameter seal portion has an outer diameter smaller than or equal to 3.5 mm, and an outer diameter of a tip end portion of the metal terminal is larger than the outer diameter of the small-diameter seal portion.

3. The spark plug according to claim 1, wherein a tip end of the metal terminal is disposed inside the tapered seal portion.

4. The spark plug according to claim 1, wherein the electrically-conductive seal portion includes a resistive-material phase made of a resistive material, a rear-end seal phase disposed closer to a rear end of the spark plug than the resistive-material phase and made of a glass seal material, and a tip-end seal phase disposed closer to the tip end of the spark plug than the resistive-material phase and made of the glass seal material, and wherein the tapered seal portion includes the rear-end seal phase.

5. The spark plug according to claim 1, wherein a ratio of the outer diameter of the small-diameter seal portion to the outer diameter of the large-diameter seal portion is larger than or equal to 0.75 and smaller than or equal to 0.90.

6. The spark plug according to claim 2, wherein a tip end of the metal terminal is disposed inside the tapered seal portion.

7. The spark plug according to claim 2, wherein the electrically-conductive seal portion includes a resistive-material phase made of a resistive material, a rear-end seal phase disposed closer to a rear end of the spark plug than the resistive-material phase and made of a glass seal material, and a tip-end seal phase disposed closer to the tip end of the spark plug than the resistive-material phase and made of the glass seal material, and wherein the tapered seal portion includes the rear-end seal phase.

8. The spark plug according to claim 3, wherein the electrically-conductive seal portion includes a resistive-material phase made of a resistive material, a rear-end seal phase disposed closer to a rear end of the spark plug than the resistive-material phase and made of a glass seal material, and a tip-end seal phase disposed closer to the tip end of the spark plug than the resistive-material phase and made of the glass seal material, and wherein the tapered seal portion includes the rear-end seal phase.

9. The spark plug according to claim 2, wherein a ratio of the outer diameter of the small-diameter seal portion to the outer diameter of the large-diameter seal portion is larger than or equal to 0.75 and smaller than or equal to 0.90.

10. The spark plug according to claim 3, wherein a ratio of the outer diameter of the small-diameter seal portion to the outer diameter of the large-diameter seal portion is larger than or equal to 0.75 and smaller than or equal to 0.90.

11. The spark plug according to claim 4, wherein a ratio of the outer diameter of the small-diameter seal portion to the outer diameter of the large-diameter seal portion is larger than or equal to 0.75 and smaller than or equal to 0.90.

* * * * *